US005970533A

United States Patent [19]

Chang

[11] Patent Number: 5,970,533

[45] Date of Patent: Oct. 26, 1999

[54] BENDABLE STEAMER ARM FOR FACIAL STEAMER

[76] Inventor: Henry Ping Chang, 2690 California Blvd., San Marino, Calif. 91108

[21] Appl. No.: 09/139,944

[22] Filed: Aug. 25, 1998

[51] Int. Cl.[6] ..... A61H 33/12

[52] U.S. Cl. ..... 4/537; 4/535

[58] Field of Search ..... 4/535, 536, 537; 604/291

[56] References Cited

U.S. PATENT DOCUMENTS 2,316,333 4/1943 Hillebrand ..... 4/535

FOREIGN PATENT DOCUMENTS 575756 12/1993 European Pat. Off. ..... 4/535

*Primary Examiner*—Robert M. Fetsuga

*Attorney, Agent, or Firm*—David and Raymond; Raymond Y. Chan

[57] ABSTRACT

A bendable steamer arm for facial steamer includes a tubular rear-arm having a front end and a rear end rotatably mounted on a steamer machine, a fore-arm having a connecting end and a steam spreading opening provided thereon, a connector joint adapted for connecting the front end of the rear-arm with the connecting end of the fore-arm in a bendable manner, and a bendable steam tube extending from the steamer machine to the fore-arm and passing through the connector joint for transmitting steam generated by the steamer machine to the steam spreading opening of the fore-arm of the steamer arm. Therefore, the bendable steamer arm enables a fore-arm of the steamer arm to bend left and right with respect to a rear-arm of the steamer arm, so as to enable the cosmetician to rapidly adjust the operation angle of the steamer arm and easily aim the steam outlet provided on the fore-arm at the affected part of the patient.

18 Claims, 7 Drawing Sheets

BENDABLE STEAMER ARM FOR FACIAL STEAMER

FIELD OF THE PRESENT INVENTION

The present invention relates to facial steamer, and more particular to a bendable steamer arm for facial steamer, wherein the bendable steamer arm can be bent to adjust its operating angle for enabling the cosmetician to rapidly position the steam outlet thereof without moving the facial steamer or the patient.

BACKGROUND OF THE PRESENT INVENTION

The facial steamer is a machine for generating atomized steam spreading onto a patient's face or body skin for cleaning and relaxing purposes. After the skin is spread with the atomized steam, the cosmetician can massage the skin and clean out the dirt particle from the skin pores.

However, in other to accomplish the above object, the steam outlet must aim at the affected part of the patient to enable the steam directly spreading on the affected part in order to achieve the best effect. In other words, whether the steam outlet of the facial steamer can be positioned close to the affected part and correctly aimed at the affected part become the major keys of the performance of the facial steamer.

As shown in FIG. 1A, the first generation facial steamer is a very basic equipment that comprises only a steamer machine 100 and a steamer arm 101 rigidly extended from the steamer machine 100. A far end of the steamer arm 101 provides a steam outlet 102 for spreading out steam at a fixed angle, i.e. it can not be adjusted to other desired position. Therefore, the cosmetician has to adjust the position of the patient by moving up and down or left and right to adapt the location of the fixed steam outlet 102 of the facial steamer 100. It causes a lot of unreasonable troublesome but still can not ensure the atomized steam effectively spreading on to the affected part of the patient.

As shown in FIG. 1B, a second generation facial steamer has improved over the first generation facial steamer, in which a steamer arm 201 is reconstructed to pivotally mounted on a side of the steamer machine 200 by a rotation joint, so that the steamer arm 201 is able to be adjusted with certain rotating angle so as to adjust its steam spreading height with respect to the patient. Even though the second generation facial steamer can freely adjust the height of the steam outlet by rotating the steamer arm up and down, the cosmetician still has to move the whole facial steamer machine 200 forth and back to align with the patient's face. Even it is a simple type facial steamer as shown in FIG. 1B, the moving adjustment of the whole facial steamer is already very inefficient and troublesome. If the facial steamer is a multi-functional machine as shown in FIG. 2, its heavy weight and large size definitely cause great difficulty in such moving adjustment. Accordingly, all-angle adjustment becomes a major development target of all facial steamer manufacturers.

Besides, some of the conventional facial steamer arms comprise a rotatable head for fine adjustment, wherein a plastic tube must be connected between the rotatable head and a metal tube extended from the steamer machine so as to enable the rotatable head to turn for a limited angle. However, the plastic tube may be broken or detached from the metal tube if the user overturns the rotatable head.

SUMMARY OF THE PRESENT INVENTION

It is thus a first object of the present invention to provide a bendable steamer arm for facial steamer, which enables a fore-arm of the steamer arm to bend left and right with respect to a rear-arm of the steamer arm, so as to enable the cosmetician to rapidly adjust the operation angle of the steamer arm and easily aim the steam outlet provided on the fore-arm at the affected part of the patient.

A further object of the present invention is to provide a bendable steamer arm for facial steamer, wherein the fore-arm of the bendable steamer arm comprises a rotation means for rotating the steam outlet about the axis of fore-arm without the anxiety for being overturned, so that the cosmetician is able to further adjust the steam spreading angle by adjusting the angular position of the steam outlet.

Accordingly, in order to accomplish the above objects, the present invention provides a bendable steamer arm for facial steamer, which comprises a tubular rear-arm having a front end and a rear end rotatably mounted on a steamer machine, a fore-arm having a connecting end and a steam spreading opening provided thereon, a connector joint adapted for connecting the front end of the rear-arm with the connecting end of the fore-arm in a bendable manner, and a bendable steam tube extending from the steamer machine to the fore-arm and passing through the connector joint for transmitting steam generated by the steamer machine to the steam spreading opening of the fore-arm of the steamer arm.

The connector joint comprises a pair of holder wings parallelly and frontwardly extended from the front end of the rear-arm and a pair of turner wings parallelly and rearwardly extended from the connecting end of the forearm. The two turner wings are pivotally connected to the two holder wings respectively so that the two turner wings are able to pivotally swing left and right with respect to the two holder wings. Each of the turner wings has a trapezoid end defining two inclined comer edges. Each of the holder wings has a pair of stoppers oppositely provided at two sides thereof respectively, wherein the two stoppers of the holder wing are protruded towards the respective turner wing pivotally connected thereto. Therefore, the two turner wings can be swung to the left or right until either the right-side or the left-side inclined corner edges of the two turner wings is blocked by the right-side or the left side stoppers of the holder wings, so as to limit the swinging angle of the two turner wings as well as the bending angle of the fore-arm of the steamer arm.

Moreover, in order to enable the cosmetician or the user of the facial steamer to also adjust the steaming angle and position of the steam outlet, the fore-arm further comprises a rotation means for rotating the steam outlet about the axis of forearm. The rotation means comprises a rotation sleeve rotatably and coaxially enclosing a front tube of the fore-arm where the steam spreading opening is positioned. The rotation sleeve has a steam outlet provided thereon and defines an interior steam chamber between the front tube of the fore-arm and an inner wall thereof, so that the steam discharged from the steam spreading opening will enter the steam chamber and exit through the steam outlet. A C-ring groove is provided around the fore-arm. The inner wall of the rotation sleeve inwardly protruded a stopping stub inserted in the C-ring groove, so as to limit the rotation angle of the rotation sleeve. Therefore, by rotating the rotation sleeve, the user or the cosmetician can freely adjust the spreading angle and position of the steam outlet without the anxiety for being overturned.

DETAILED DESCRIPTION OF THE PREFERRED EMBODIMENT

Figure 1A:
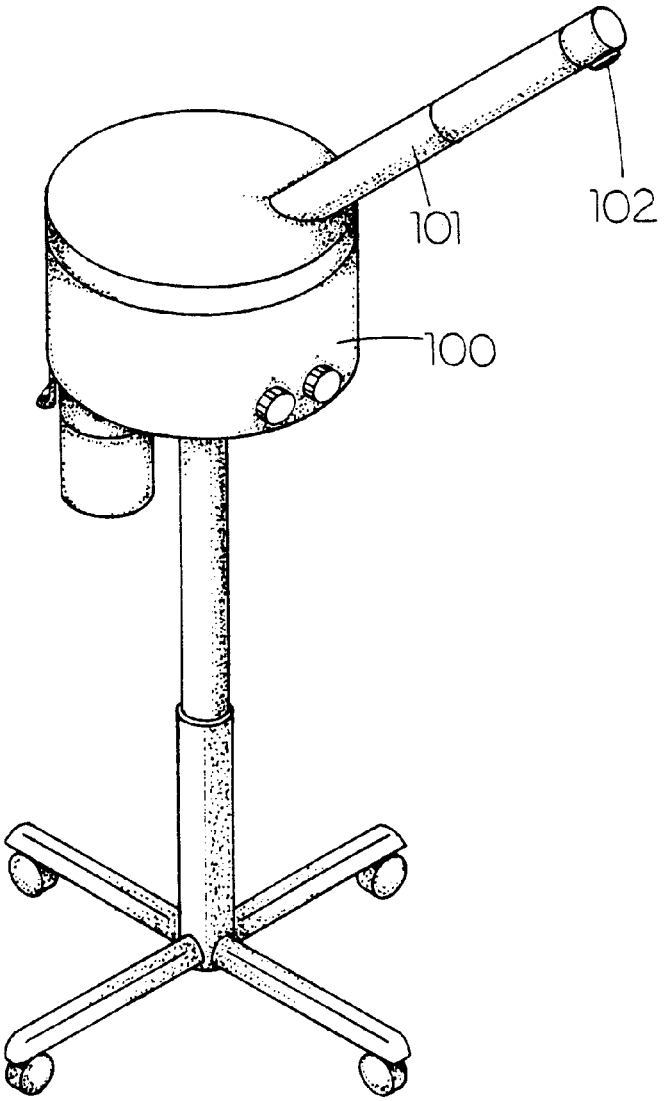
PRIOR ART FIG. 1A
FIG. 1A is a perspective view of a first generation facial steamer.
Figure 1B:
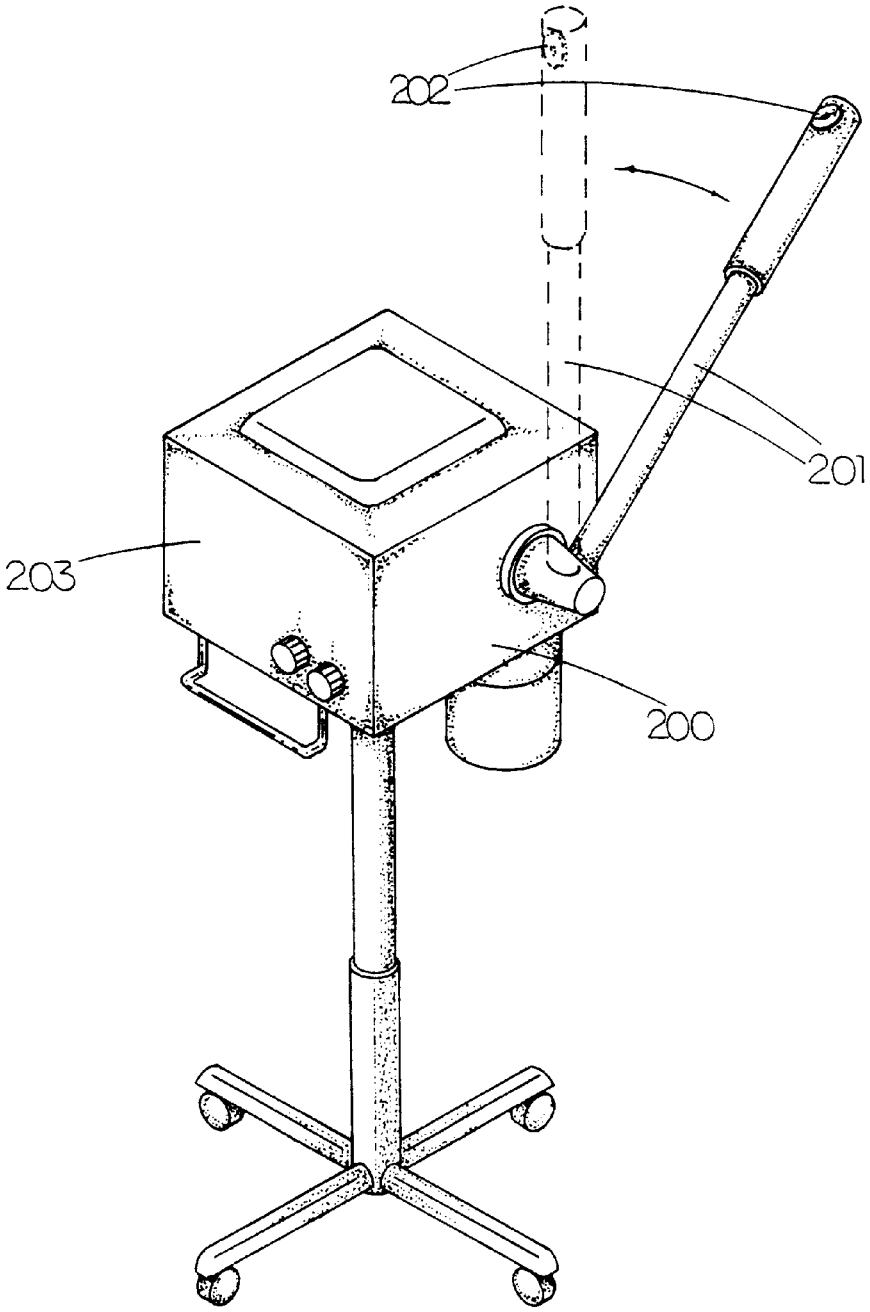
PRIOR ART FIG. 1B
FIG. 1B is a perspective view of a second generation facial steamer.
Figure 2:
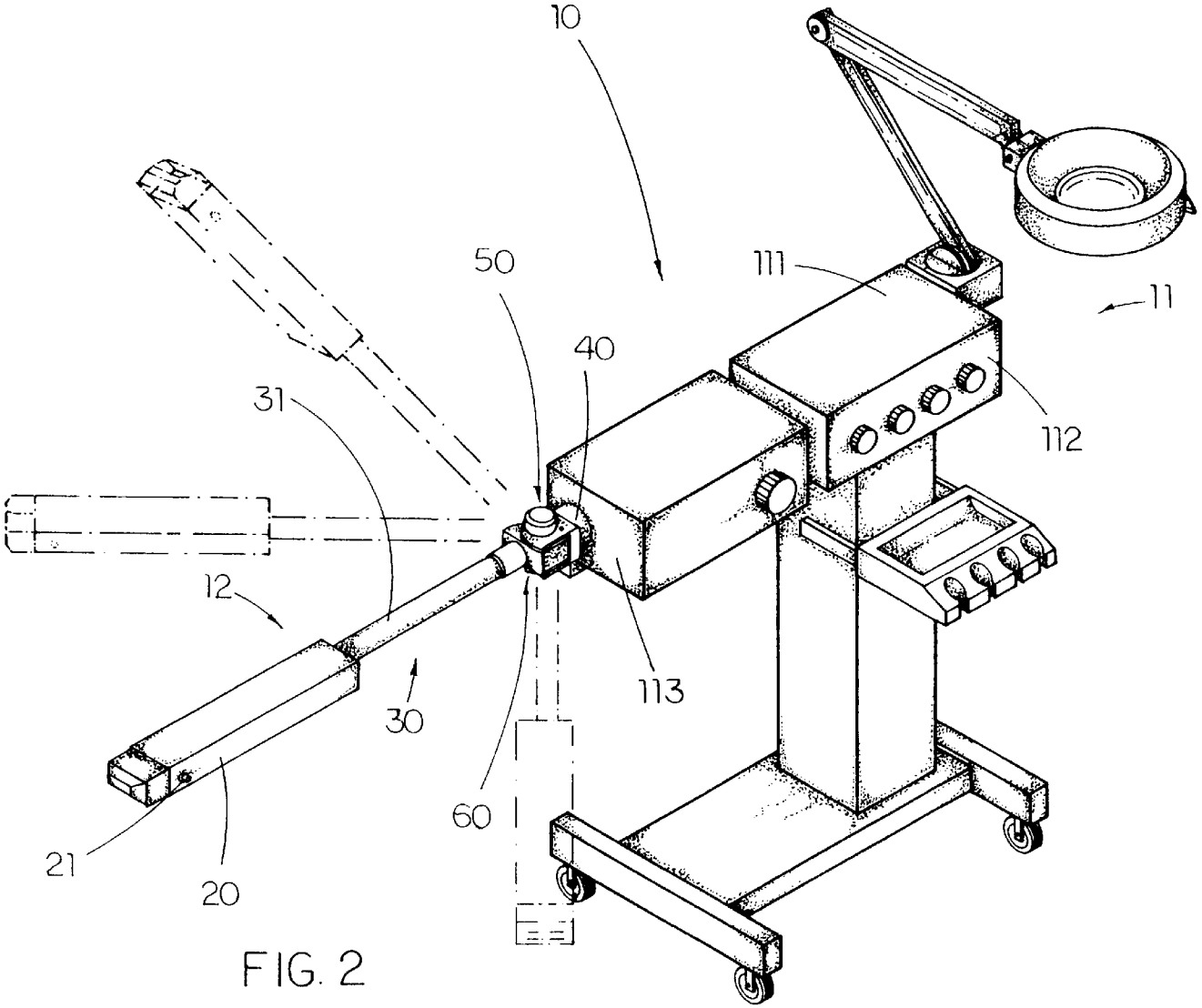
FIG. 2 is a perspective view of a facial steamer installed with a bendable steamer arm according to a preferred embodiment of the present invention.
Figure 3:
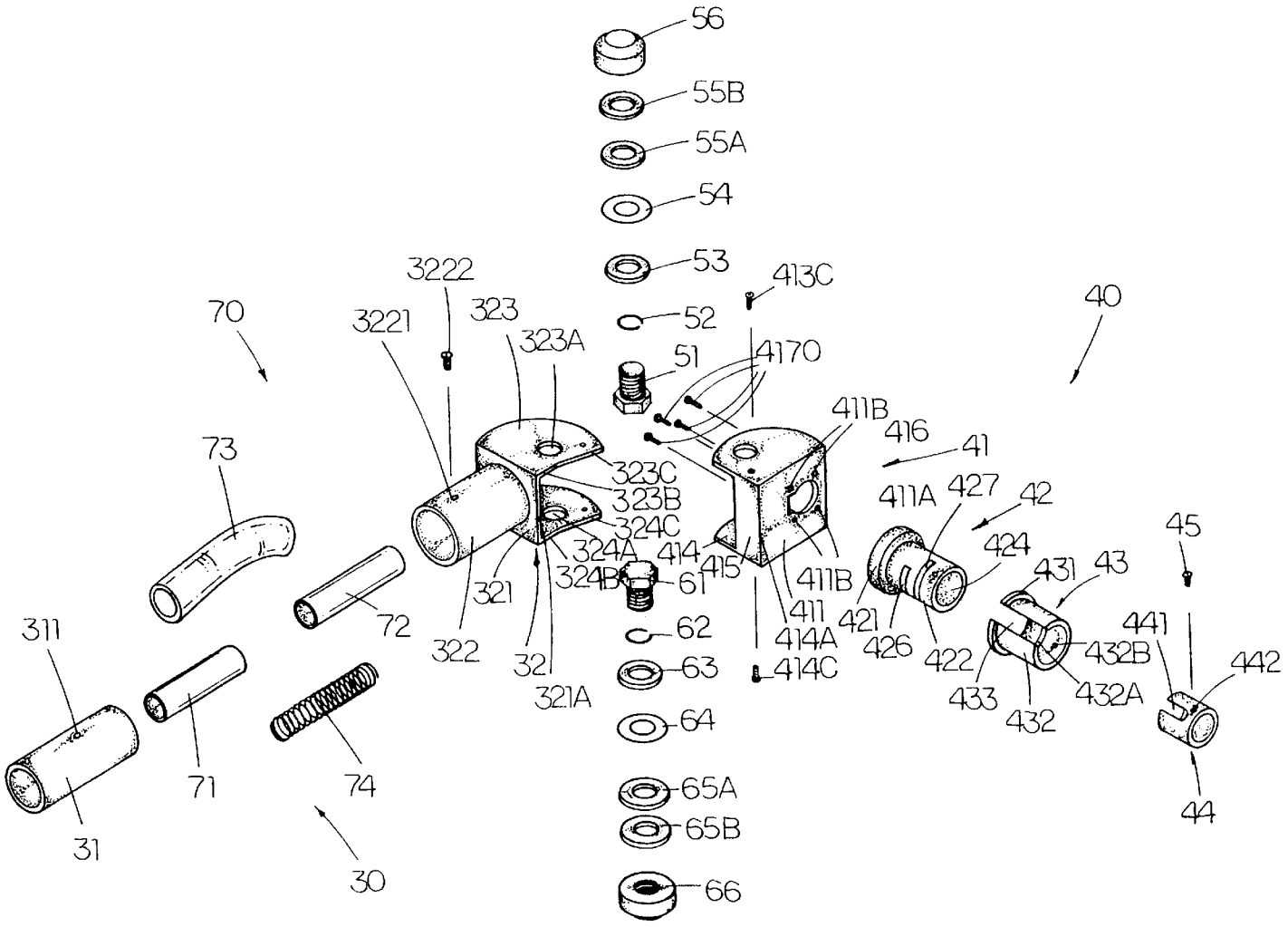
FIG. 3 is an enlarged perspective view of the connector joint of the bendable steamer arm according to the above preferred embodiment of the present invention.

Referring to FIGS. 2 to 4, a bendable steamer arm for facial steamer of the present invention is illustrated. As shown in FIG. 2, the bendable steamer arm comprises a tubular rear-arm 1 having a front end 11 and a rear end 12 rotatably mounted on a side of a steamer machine 5 by means of a rotation joint 13, a fore-arm 3 having a connecting end 31 and a steam spreading opening 341 provided thereon, a connector joint 2 adapted for connecting the front end 11 of the rear-arm 1 with the connecting end 31 of the fore-arm 3 in a bendable manner, and a bendable steam tube 4 extending from the steamer machine 5 to the fore-arm 3 and passing through the connector joint 2 for transmitting steam generated by the steamer machine 5 to the steam spreading opening 341 of the fore-arm 3 of the bendable steamer arm.

As shown in FIG. 3, the connector joint 2 comprises a pair of holder wings 21 parallelly and frontwardly extended from the front end 11 of the rear-arm 1 and a pair of turner wings 23 parallelly and rearwardly extended from the connecting end 31 of the fore-arm 3. The two turner wings 23 are pivotally connected to the two holder wings 21 by two rivets 22 respectively, so that the two turner wings 23 are able to pivotally swing left and right with respect to the two holder wings 21. Each of the turner wings 23 has a trapezoid end 230 defining two inclined corner edges 231, 232. Each of the holder wings 21 has a pair of stoppers 211, 212 oppositely provided at two sides thereof respectively, wherein the two stoppers 211, 212 of each holder wing 21 are protruded towards the bendable steam tube 4 passing between the two holder wings 21.

According to the present preferred embodiment, the two holder wings 21 are two rectangular plates each having an affixing end 213 firmly affixed to the front end 11 of the rear-arm 1 in a parallel manner and a supporting end 214 frontwardly extended to support the respective turner wing 23. The two stoppers 211, 212 of each holder wing 21 are two side stubs oppositely and integrally bent towards the stoppers 211, 212 of another parallel holder wing 21 respectively. The two stoppers 211, 212 of each holder wing 21 are positioned between the affixing end 213 and the supporting end of the holder wing 21.

Figure 4A:
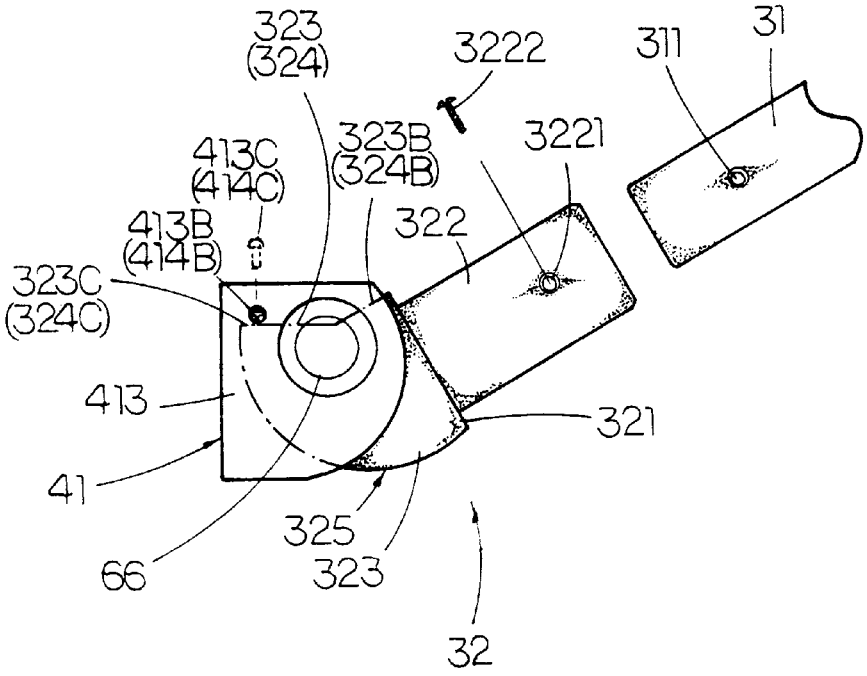
FIG. 4A is a partial plan view of FIG. 3, wherein the fore-arm is linearly position with the rear-arm of the bendable steamer arm.

As shown in FIGS. 3 and 4A, the two turner wings 23 are two rectangular plates, wherein one end of each turner wing 23 is the trapezoid end 230 while another end firmly affixed to the rear end 31 of the fore-arm 3. The two turner wings 23 are positioned between the two holder wings 21 and pivotally connected with the supporting ends 214 of the two holder wings 21 respectively, wherein the two inclined corner edges 231, 232 of each turner wing 23 are positioned between the two stoppers 211, 212 of the respective holder wing 21, as shown in FIG. 4A.

Figure 4B:
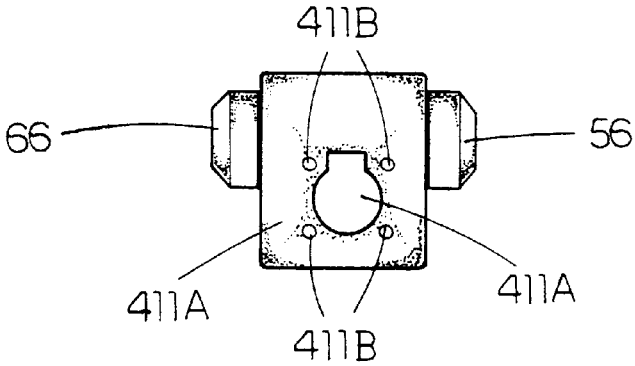
FIG. 4B is a partial plan view of FIG. 3, wherein the fore-arm is swung to a right position with respect to the rear-arm of the bendable steamer arm.

As shown in FIG. 4B, the two turner wings 23 can be swung to the right until the left-side inclined corner edges 232 of the two turner wings 23 are blocked by the left side stoppers 211 of the two holder wings 21, thereby the fore-arm 3 is bent to the right with respect to the rear-arm 1.

Figure 4C:
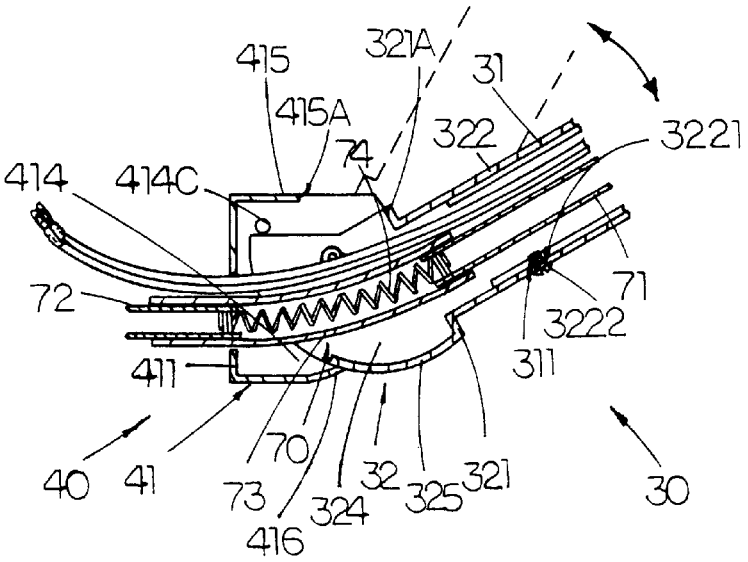
FIG. 4C is a partial plan view of FIG. 3, wherein the fore-arm is swung to a left position with respect to the rear-arm of the bendable steamer arm.

As shown in FIG. 4C, the two turner wings 23 can be swung to the left until the right-side inclined corner edges 231 of the two turner wings 23 are blocked by the right side stoppers 212 of the two holder wings 21, thereby the fore-arm 3 is bent to the left with respect to the rear-arm 1.

Therefore, as shown in FIGS. 4B and 4C, the left to right swinging angle of the two turner wings 23 with respect to the holder wings 21 as well as the bending angle of the fore-arm 3 of the steamer arm can be limited by the stoppers 211, 212 of the two holder wings 21. According to the present embodiment as shown in the drawings, the holder wings 21 have the same width of the turner wings 23. The bending angle of the fore-arm 3 is wider if the width of the holder wings 21 is larger than the width of the turner wings 23.

As shown in FIGS. 2 and 3, the bendable steam tube 4, which is made of bendable heat resistant plastic material, extends between the two holder wings 21 and the two turner wings 23. The stoppers 211, 212 of the two holder wings 21 can also prevent the bendable tube 4 from over-bent that will block or even stop the steam supply therethrough. Moreover, as shown in FIG. 2, a flexible cover tube 6 can be connected between the front end 11 of the rear-arm I and the connecting end 31 of the fore-arm 3 to enclose the connector joint 2 therein for protecting the bendable steam tube 4.

Figure 5:
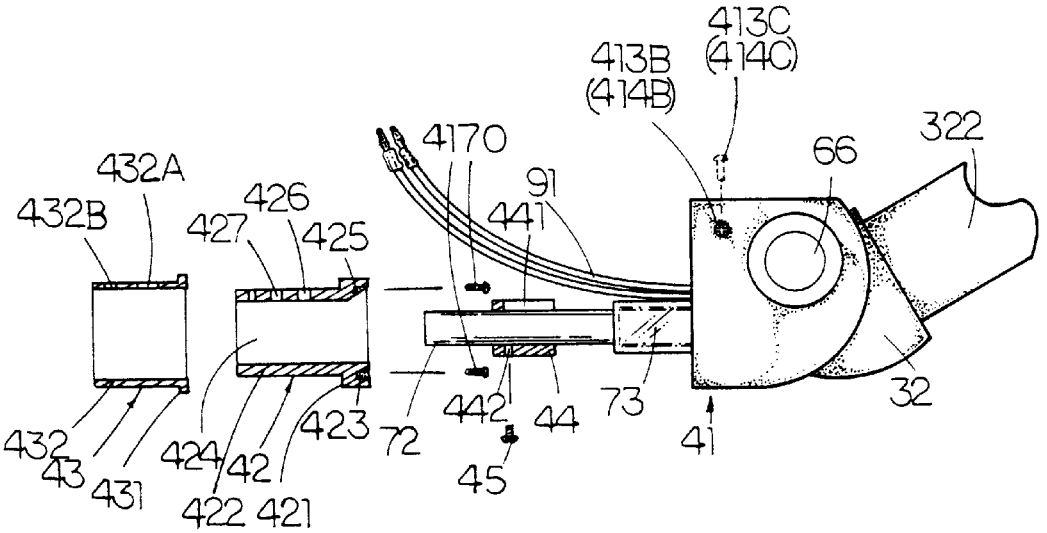
FIG. 5 is a sectional side view of the fore-arm of the bendable steamer arm according to the above preferred embodiment of the present invention.
Figure 6:
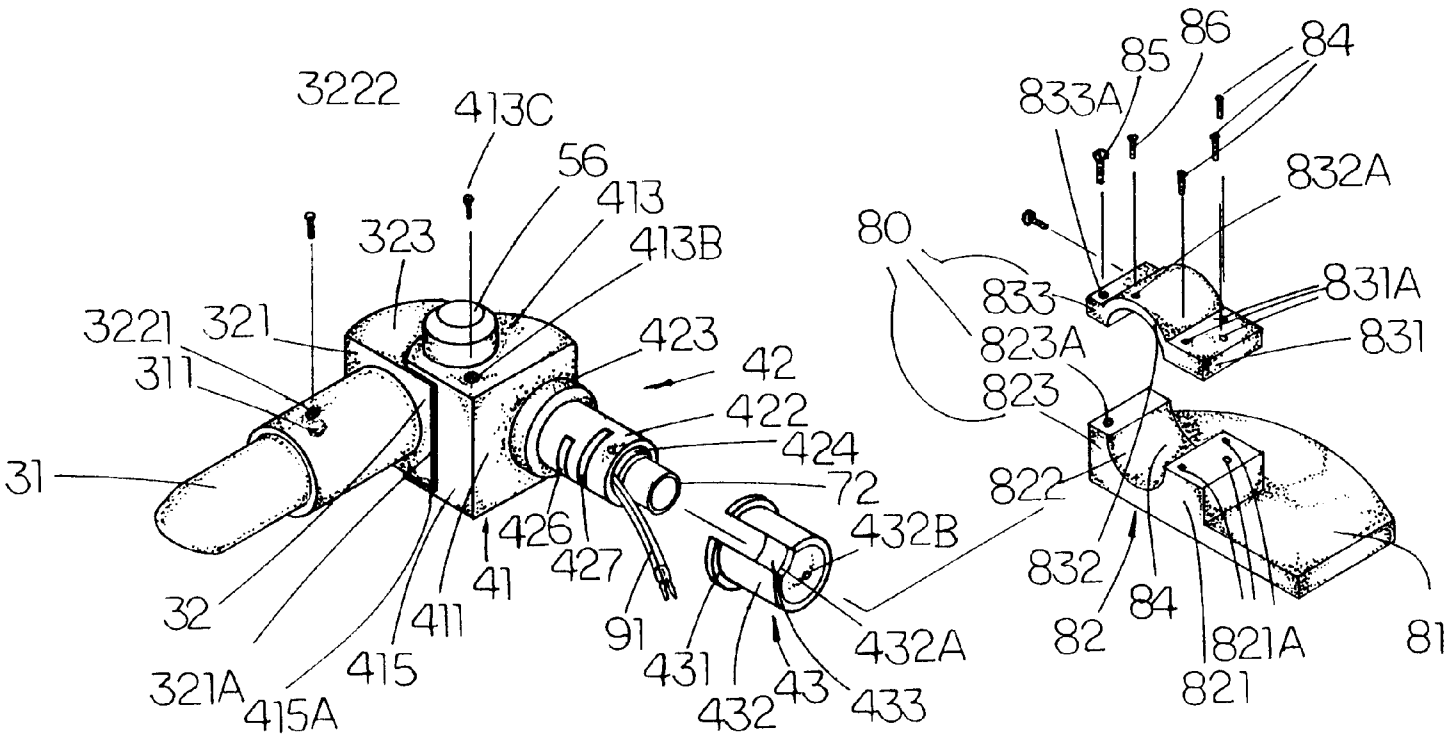
FIG. 6 is a sectional end view of the fore-arm of the bendable steamer arm according to the above preferred embodiment of the present invention.

Moreover, as shown in FIGS. 5 and 6, in order to enable the cosmetician or the user of the facial steamer to also adjust the steaming angle and position, the fore-arm 3 further comprises a rotation means having a steam outlet 321 thereon for rotating the steam outlet 321 about the axis of fore-arm 3. The fore-arm 3 comprises a front tube rotatably connected to a front end thereof. The rotation means 32 comprises a rotation sleeve 32 rotatably and coaxially enclosing the front tube 34 where the steam spreading opening 341 positioned. According to the present embodiment, the front tube 34 is a metal tube affixed to a front end of the fore-arm 3, which free end is affixed to a rotating plate 33 that is rotatably mounted inside the rotation sleeve 32 for supporting purpose.

The rotation sleeve 32 defines an interior steam chamber 300 between the front tube 34 of the fore-arm 3 and an inner wall 320 thereof, so that the steam discharged from the steam spreading opening 341 will enter the steam chamber 300 and exit through the steam outlet 321. A C-ring groove 312 is provided around the fore-arm 3 and defines a blocking stub 313 between two ends of the C-ring groove 312, i.e. said C-ring groove is extended from one side of a blocking stub 313 to another side of the blocking stub 313, as shown in FIG. 6. The inner wall 320 of the rotation sleeve 32 inwardly protruded a stopping stub 323 which is inserted in the C-ring groove 312, so that the rotation angle of the rotation sleeve 32 is limited to less than 360 degree because the stopping stub 323 is blocked by the blocking stub 313 during rotation. Therefore, as shown in FIG. 6, by rotating the rotation sleeve 32, the user or the cosmetician can freely adjust the spreading angle and position of the steam spreading opening 341 and the steam outlet 321.

As shown in FIG. 2, if consider 3-dimensionally, the axle of the rotation joint 12 can be considered as the X-axis, and the steamer arm can be considered as the Y-axis. The user or cosmetician not only can adjust the height of the steam spreading opening 341 and the steam outlet 321 by rotating the whole steamer arm about the rotation joint 12 (i.e. adjusting on a Y-Z axis plane), but also can bend the fore-arm 3 of the steamer arm to the left or right so as to adjust the forth or back position of the steam spreading opening 341 and the steam outlet 321 (i.e. adjusting on a X-Y axis plane). Furthermore, the rotation of the rotation sleeve 32 can also adjust the spreading angle and position of the steam outlet 321 (i.e. adjusting about the Y-axis). In other words, the bendable steamer arm of the present invention enables the user or cosmetician to adjust the steam outlet 321 3-dimensionally, so that the cosmetician can rapidly adjust the operation angle of the steamer arm and easily aim the steam outlet 321 provided on the rotation sleeve 32 at the affected part of the patient.

What is claimed is:

1. A bendable steamer arm for facial steamer, comprising a tubular rear-arm having a front end and a rear end rotatably mounted on a steamer machine;

a fore-arm having a connecting end and a steam spreading opening provided thereon;

a connector joint adapted for connecting said front end of said rear-arm with said connecting end of said fore-arm in a bendable manner, wherein said connector joint comprises a pair of holder wings parallelly and frontwardly extended from said front end of said rear-arm and a pair of turner wings parallelly and rearwardly extended from said connecting end of said fore-arm, wherein said two turner wings are pivotally connected to said two holder wings respectively so that said two turner wings are able to pivotally swing left and right with respect to said two holder wings, each of said turner wings having a trapezoid end providing two inclined corner edges, each of said holder wings having a pair of stoppers oppositely provided at two sides thereof respectively, wherein said two stoppers of each of said holder wings are protruded towards the other holder wing, wherein said two turner wings are able to swing to left or right until either said right-side or said left-side inclined corner edges of said two turner wings are blocked by said right-side or said left side stoppers of said two holder wings, so as to limit a swinging angle of said two turner wings as well as said bending angle of said fore-arm of said steamer arm; and a bendable steam tube extending from said steamer machine to said fore-arm and passing through said connector joint for transmitting steam generated by said steamer machine to said steam spreading opening of said fore-arm.

2. A bendable steamer arm for facial steamer, as recited in claim 1, wherein said fore-arm further comprises a rotation means having a steam outlet thereon for rotating said steam outlet about said axis of fore-arm, said fore-arm further comprising a front tube rotatably connected to a front end thereof, said rotation means comprising a rotation sleeve rotatably and coaxially enclosing said front tube where said steam spreading opening is positioned, wherein said steam outlet is provided on said rotation sleeve and an interior steam chamber is defined between said front tube of said fore-arm and an inner wall of said rotation sleeve, so that said steam discharged from said steam spreading opening of said fore-arm exits through said steam outlet, wherein a C-ring groove is provided around said fore-arm and defines a blocking stub between two ends of said C-ring groove, said inner wall of said rotation sleeve inwardly protruding a stopping stub which is inserted in said C-ring groove, wherein a rotation angle of said rotation sleeve is limited to less than 360 degree because said stopping stub is blocked by the blocking stub during rotation.

3. A bendable steamer arm for facial steamer, as recited in claim 1, wherein said two holder wings are two rectangular plates each having an affixing end firmly affixed to said front end of said rear-arm in a parallel manner and a supporting end frontwardly extended to support said respective turner wing, and that said two stoppers of each of said holder wings are two side stubs oppositely and integrally bent towards said stoppers of said another parallel holder wing respectively, in which said two stoppers of each of said holder wings are positioned between said affixing end and said supporting end of said holder wing.

4. A bendable steamer arm for facial steamer, as recited in claim 2, wherein said two holder wings are two rectangular plates each having an affixing end firmly affixed to said front end of said rear-arm in a parallel manner and a supporting end frontwardly extended to support said respective turner wing, and that said two stoppers of each of said holder wings are two side stubs oppositely and integrally bent towards said stoppers of said another parallel holder wing respectively, in which said two stoppers of each of said holder wings are positioned between said affixing end and said supporting end of said holder wing.

5. A bendable steamer arm for facial steamer, as recited in claim 3, wherein said two turner wings are two rectangular plates, and one end of each turner wing is said trapezoid end while another end thereof is firmly affixed to said rear end of said fore-arm, wherein said two turner wings are positioned between said two holder wings and pivotally connected with said supporting ends of said two holder wings respectively, and that said two inclined corner edges of each of said turner wings are positioned between said two stoppers of said respective holder wing.

6. A bendable steamer arm for facial steamer, as recited in claim 4, wherein said two turner wings are two rectangular plates, and one end of each turner wing is said trapezoid end while another end thereof is firmly affixed to said rear end of said fore-arm, wherein said two turner wings are positioned between said two holder wings and pivotally connected with said supporting ends of said two holder wings respectively, and that said two inclined corner edges of each of said turner wings are positioned between said two stoppers of said respective holder wing.

7. A bendable steamer arm for facial steamer, as recited in claim 1, further comprising a flexible cover tube connected between said front end of said rear-arm and said connecting end of said fore-arm to enclose said connector joint therein for protecting said bendable steam tube.

8. A bendable steamer arm for facial steamer, as recited in claim 2, further comprising a flexible cover tube connected between said front end of said rear-arm and said connecting end of said fore-arm to enclose said connector joint therein for protecting said bendable steam tube.

9. A bendable steamer arm for facial steamer, as recited in claim 3, further comprising a flexible cover tube connected between said front end of said rear-arm and said connecting end of said fore-arm to enclose said connector joint therein for protecting said bendable steam tube.

10. A bendable steamer arm for facial steamer, as recited in claim 4, further comprising a flexible cover tube connected between said front end of said rear-arm and said connecting end of said fore-arm to enclose said connector joint therein for protecting said bendable steam tube.

11. A bendable steamer arm for facial steamer, as recited in claim 5, further comprising a flexible cover tube connected between said front end of said rear-arm and said connecting end of said fore-arm to enclose said connector joint therein for protecting said bendable steam tube.

12. A bendable steamer arm for facial steamer, as recited in claim 6, further comprising a flexible cover tube connected between said front end of said rear-arm and said connecting end of said fore-arm to enclose said connector joint therein for protecting said bendable steam tube.

13. A bendable steamer arm for facial steamer, as recited in claim 2, wherein said front tube is a metal tube affixed to a front end of said fore-arm which free end is affixed to a rotating plate that is rotatably mounted inside said rotation sleeve for supporting purpose.

14. A bendable steamer arm for facial steamer, as recited in claim 4, wherein said front tube is a metal tube affixed to a front end of said fore-arm which free end is affixed to a rotating plate that is rotatably mounted inside said rotation sleeve for supporting purpose.

15. A bendable steamer arm for facial steamer, as recited in claim 6, wherein said front tube is a metal tube affixed to a front end of said fore-arm which free end is affixed to a rotating plate that is rotatably mounted inside said rotation sleeve for supporting purpose.

16. A bendable steamer arm for facial steamer, as recited in claim 8, wherein said front tube is a metal tube affixed to a front end of said fore-arm which free end is affixed to a rotating plate that is rotatably mounted inside said rotation sleeve for supporting purpose.

17. A bendable steamer arm for facial steamer, as recited in claim 10, wherein said front tube is a metal tube affixed to a front end of said fore-arm which free end is affixed to a rotating plate that is rotatably mounted inside said rotation sleeve for supporting purpose.

18. A bendable steamer arm for facial steamer, as recited in claim 12, wherein said front tube is a metal tube affixed to a front end of said fore-arm which free end is affixed to a rotating plate that is rotatably mounted inside said rotation sleeve for supporting purpose.

* * * * *